United States Patent [19]

Matty et al.

[11] 4,098,608

[45] Jul. 4, 1978

[54] METAL POWDER COMPOSITIONS

[75] Inventors: Michael Thomas Matty, Stratford upon Avon; Philip James Ridout, Chipping Campden, both of England

[73] Assignee: B.S.A. Sintered Components Limited, Birmingham, England

[21] Appl. No.: 739,952

[22] Filed: Nov. 8, 1976

[30] Foreign Application Priority Data

Nov. 12, 1975 [GB] United Kingdom ..... 46670/75

[51] Int. Cl.[2] ..... C22C 1/05

[52] U.S. Cl. ..... 75/251; 75/254; 75/255

[58] Field of Search ..... 75/0.5 BA, 0.5 R, 251, 75/254, 255

[56] References Cited

U.S. PATENT DOCUMENTS

| | | | |
|---|---|---|---|
| 3,798,022 | 3/1974 | LeBrasse et al. | 75/0.5 BA |
| 3,901,661 | 8/1975 | Kondo et al. | 75/0.5 BA |

FOREIGN PATENT DOCUMENTS

| | | | |
|---|---|---|---|
| 692,687 | 8/1964 | Canada | 75/0.5 R |
| 975,322 | 11/1964 | United Kingdom | 75/0.5 R |
| 1,305,608 | 2/1973 | United Kingdom. | |

*Primary Examiner*—W. Stallard

*Attorney, Agent, or Firm*—Oblon, Fisher, Spivak, McClelland & Maier

[57] ABSTRACT

In a mixture of metal powders from which ferrous alloy articles may be made by the process of powder metallurgy, the mixture consisting of the following in percentages by weight; nickel, 0.5 to 4%, manganese, 0.5 to 6%, carbon (graphite), 0.05 to 1.5%, copper, if present, up to 5%, boron, if present, up to 0.4%, iron and usual impurities, balance to 100%, the improvement consisting in that the nickel and manganese are in the form of a powdered binary alloy having a nickel to manganese ratio by weight in the range 15 : 85 to 65 : 35 and all of said powdered alloy passes through a 400 mesh B.S.S. sieve.

10 Claims, No Drawings

METAL POWDER COMPOSITIONS

The present invention relates to improvements in the composition of metal powders from which ferrous alloy articles can be made using powder metallurgy techniques. In particular, the invention provides a metal powder of this kind which provides articles having improved wear-resistance.

U.K. Patent Specification No. 975,322 discloses and claims a mixture of metal powders from which ferrous alloy articles can be made by process of powder metallurgy, the mixture consisting of the following in percentages by weight:

| | |
|---|---|
| Nickel | 0.5 to 6% |
| Copper | 0.5 to 5% |
| Manganese | 0.5 to 4% |
| Boron | 0.01 to 0.4% |
| Carbon (graphite) | 0.05 to 1.5% |
| Iron and usual impurities | Balance to 100% |

The addition of manganese as an elemental powder in said mixture has the disadvantage that manganese is readily oxidized and the resultant oxide layer formed on the manganese particles is difficult to reduce. The boron content of the said mixture was required in order to reduce the oxide since the presence of oxide inhibits alloying and diffusion and causes a variation in the properties, especially for wear resistance, of articles made from the powder mixture. However, the presence of the boron failed to satisfactorily overcome this problem when articles of consistently high wear-resistance were required.

We have disclosed in our co-pending U.K. Patent Application No. 46671/75 that the problems associated with the presence of manganese oxide in said mixture can be overcome and articles of improved wear-resistance obtained by adding the nickel and manganese content of the mixture solely in the form of a binary alloy having a nickel to manganese ratio by weight in the range 15 : 85 to 65 : 35. In particular, said Application discloses and claims a mixture consisting of the following in percentages by weight:

| | |
|---|---|
| Nickel | 0.5 to 4% |
| Manganese | 0.5 to 6% |
| Carbon (graphite) | 0.05 to 1.5% |
| Copper, if present | Up to 5% |
| Boron, if present | Up to 0.4% |
| Iron and usual impurities | Balance to 100% |

wherein the nickel and manganese are added in the form of a powdered binary alloy having a nickel to manganese ratio by weight in the range 15 : 85 to 65 : 35. Whilst said mixtures produce by powder metallurgy articles of comparatively high wear resistance using alloy particles of size distributions conventionally used in powder metallurgy obtained, for example, by milling (see Powder 2 of the Example), we found that the variation in wear resistance of the articles was unacceptable for certain applications. Surprisingly, it has now been found that said variation can be significantly reduced by use of alloy particles of a size such that at least 80% pass through a 325 mesh B.S.S. sieve.

According to the present invention, there is provided a mixture of metal powders from which ferrous alloy articles may be made by the process of powder metallurgy, the mixture consisting of the following (percentages by weight):

| | |
|---|---|
| Nickel | 0.5 to 4% |
| Manganese | 0.5 to 6% |
| Carbon (graphite) | 0.05 to 1.5% |
| Copper, if present | Up to 5% |
| Boron, if present | Up to 0.4% |
| Iron and usual impurities | Balance to 100% |

wherein the nickel and manganese are added in the form of a powdered binary alloy having a nickle to manganese ratio by weight in the range 15 : 85 to 65 : 35, and at least 80% of said powdered alloy passes through a 325 mesh B.S.S. sieve.

Advantageously, the mixture of the invention contains nickel, manganese and carbon in the following percentages by weight:

| | |
|---|---|
| Nickel | 1.4 to 2.8% |
| Manganese | 2.1 to 3.9% |
| Carbon | 1.05 to 1.5%. |

It is preferred that, for maximum wear-resistance said elements should be present in the following percentages by weight:

| | |
|---|---|
| Nickel | 1.9 to 2.8% |
| Manganese | 3.0 to 3.9% |
| Carbon | 1.05 to 1.5%, especially 1.3 to 1.5%. |

An advantage of the use of a nickel-manganese binary alloy as aforesaid is that alloys within the range specified are present in the liquid phase at a temperature of around 1150° C, which is commonly used sintering temperature, and therefore readily diffuse through the sintered composition. It is preferred to use a nickel-manganese alloy with a nickel to manganese ratio in the range of 20 : 80 to 55 : 45, which alloys are present in the liquid phase at a temperature of 1100° C, and most preferably a continuous solubility alloy with a nickel to manganese ratio of about 40 : 60 is used, which alloy has a melting point of about 1025° C. It should be understood that notwithstanding the foregoing, higher sintering temperatures of up to 1350° C may be used in order to achieve higher diffusion rates.

At least 80%, and preferably all, of the binary alloy particles in the mixture of the invention pass through a 325 mesh B.S.S. sieve. Particularly high quality articles are obtained if at least 60%, advantageously 80% and especially all, of the binary alloy particles pass through a 400 mesh B.S.S. sieve. The selection of particle size ensures that the sintered product has a high retained austenite content. We have found that the wear-resistance of articles made from metal powders is directly proportional to the retained austenite content and this can be explained by the fact that austenite breaks down on the application of energy to form martensite and hence produces an increase in hardness.

It is preferred that the components of the mixture except the iron powder all pass through a 300 mesh B.S.S. sieve. In the case of the iron powder, preferably all particles pass through a 100 mesh B.S.S. sieve with 75% passing through a 200 mesh B.S.S. sieve and 50% passing through a 300 mesh B.S.S. sieve.

The carbon is preferably added as fine graphite powder ("micronised graphite") and is preferably added in the range of 0.45 to 1.5% by weight.

The iron is preferably added as a soft powder. A small proportion of the iron content may be replaced by the same weight of one or more other elements which do not adversely affect the tensile strength and ductility of the articles produced from the powders. The amount of iron so replaced does not exceed 5% of the total weight of the mixture. The following is a list of elements which may be added, the figures in brackets indicating the upper limit:

Al (1%), B (0.3%), Cr (5%), Mg (1%), Nb and/or TA (4%), P (0.3%), Si (1%), Ti (1%), W (4%), V (0.3%), Zr (0.6%), Se (0.6%), and Pb (0.5%).

Copper may be added to the composition and when so added is present in the range up to 5% by weight. The addition of copper has a beneficial effect on the strength of the sintered metal powder composition, but has little or no effect upon its wear-resistant characteristics, which characteristics are an important feature of the metal powder composition. The copper is preferably added as an elemental powder with a particle size preferably such that all of the powder will pass through a 100 mesh B.S.S. sieve.

It is an advantage of the metal powder composition according to the present invention that it is not essential to add boron, which acts as a flux, although this element can be added if so desired. The boron, when added, may constitute up to 0.4% by weight of the composition. It may be introduced as so-called amorphous boron or in the form of one or more key alloys (for example ferroboron) or in the form of one or more chemical compounds of boron such as metallic borates (for example cupric borate).

The powder mixture of the present invention can be used to make ferrous alloy articles using conventional powder metallurgy techniques. Thus, after weighing out the ingredients of the metal powder composition, the ingrediens are thoroughly mixed to produce a homogenous mixture and lubricants such as paraffin wax, stearates or other lubricants well known in the art may be incorporated in the desirable proportions. The resultant mixture is then compacted in a die under a pressure of at least fifteen tons per square inch, the compact so formed ejected from the die and sintered in the protective atmosphere, preferably cracked ammonia and propane, at a temperature between 1100° and 1350° C for at least 5 minutes.

The following Example is given to illustrate the invention, but is not intended to impose any restrictions upon the scope of the invention. All percentages given are calculated on a weight basis, and temperatures are in ° C.

EXAMPLE

Four metal powder compositions were prepared each having the same elemental composition of 1.6% nickel, 2.4% manganese, 1.25% carbon, 1.0% copper and the balance iron. In each case the nickel and manganese were added as a binary alloy having a nickel to manganese ratio of 40 to 60. The particle size of the binary alloy differed in each powder as will be explained below. In each case, the carbon was added as micronised graphite, the copper as elemental copper and the iron as soft iron. The particle size of the soft iron powder was such that all of it passed through a 100 mesh B.S.S. sieve, 75% passed a 200 mesh B.S.S. sieve and 50% passed a 300 mesh B.S.S. sieve. The graphite and copper were of particle size which passed through a 300 mesh B.S.S. sieve.

The binary alloy in Powder 1 was an atomised nickel manganese powder which would not pass through a 100 mesh B.S.S. sieve. In Powder 2, the binary alloy was a milled powder with a particle size distribution such that 0.2% of powder would not pass through a 140 mesh B.S.S. sieve, 5.2% would not pass through a 200 mesh B.S.S. sieve, 38.0% would not pass through a 325 mesh B.S.S. sieve, 31.0% would not pass through a 400 mesh B.S.S. sieve, and 25.6% would pass through a 400 mesh B.S.S. sieve. In the case of Powder 3, the binary alloy was an atomised powder with a particle size distribution such that 0.1% would not pass through a 140 mesh B.S.S. sieve, 0.2% would not pass through a 200 mesh B.S.S. sieve, 10.3% would not pass through a 325 mesh B.S.S. sieve, 26.0% would not pass through a 400 mesh B.S.S. sieve, and 63.4% would pass through a 400 mesh B.S.S. sieve. Finally, in the case of Powder 4, the binary alloy was an atomised powder which would all pass through a 400 mesh B.S.S. sieve, which powder was obtained from Powder 3 by sieving.

Each of the powders was thoroughly mixed and 0.7% zinc stearate added to the mixture as a lubricant. 1.125 inch diameter blanks were made from each of the powders by compacting to a green density of 6.8 gm/cc and sintering at 1140° for 30 minutes in a cracked ammonia and propane atmosphere. The test pieces were then subjected to hardness tests and an assay of the austenite content. The results are set forth in Table 1 below.

TABLE 1

| Powder No. | 1 | 2 | 3 | 4 |
|---|---|---|---|---|
| Average skin hardness (HV5Kg) | 191.8 | 213.3 | 229.3 | 236.6 |
| Mean austenite content | 6.57 | 8.96 | 15.5 | 17.15 |
| Standard deviation in austenite content | 2.63 | 2.71 | 2.73 | 1.68. |

It will be seen from the results set forth in Table 1 that all of the powders had better properties than would have been predicted from the prior art having regard to the omission of boron from the compositions. However, it is apparent that the particle size of the binary alloy powder has a clear effect upon the hardness and retained austenite content (and hence upon wear-resistance). Powder 3, in which 89.4% of the binary alloy passed through a 325 mesh B.S.S. sieve, is clearly superior to Powders 1 and 2 but is inferior to Powder 4, which contains a binary alloy powder of which 100% will pass through a 400 mesh B.S.S. sieve. Not only is the mean austenite content of the Powder 4 higher than that of Powder 3, but also the standard deviation is lower, that is there is less variation in the value of the austenite content. It follows that in the employment of the invention it is preferable to use a metal powder composition whose binary alloy constituent will pass completely through a 400 mesh B.S.S. sieve.

What is claimed is:

1. In a mixture of metal powders from which ferrous alloy articles may be made by the process of powder metallurgy, the mixture consisting of the following in percentages by weight:

| | |
|---|---|
| Nickel | 0.5 to 4% |
| Manganese | 0.5 to 6% |
| Carbon (graphite) | 0.05 to 1.5% |
| Copper, if present | Up to 5% |

-continued

| | |
|---|---|
| Boron, if present | Up to 0.4% |
| Iron and usual impurities | Balance to 100% |

the improvement consisting in that the nickel and manganese are in the form of a powdered binary alloy having a nickel to manganese ratio by weight in the range 15 : 85 to 65 : 35 and all of said powdered alloy passes through a 400 mesh B.S.S. sieve.

2. The mixture according to claim 1, wherein the nickel, manganese and carbon are present in the following percentages by weight:

| | |
|---|---|
| Nickel | 1.4 to 2.8% |
| Manganese | 2.1 to 3.9% |
| Carbon | 1.05 to 1.5%. |

3. The mixture according to claim 2, wherein said elements are present in the following percentages by weight:

| | |
|---|---|
| Nickel | 1.9 to 2.8% |
| Manganese | 3.0 to 3.9% |
| Carbon | 1.05 to 1.5%. |

4. The mixture according to claim 3, wherein the carbon content is 1.3 to 1.5% by weight.

5. The mixture according to claim 1, wherein the nickel to manganese ratio in the binary alloy is in the range 20 : 80 to 55 : 45 by weight.

6. The mixture according to claim 5, wherein the said alloy is a continuous solubility alloy having a nickel to manganese ratio of about 40 : 60 by weight.

7. The mixture according to claim 1, wherein all of the components of the mixture other than the iron powder pass through a 300 mesh B.S.S. sieve.

8. The mixture according to claim 7, wherein the iron is a soft iron having particles all passing through a 100 mesh B.S.S. sieve with 75% passing through a 200 mesh B.S.S. sieve and 50% passing through a 300 mesh B.S.S. sieve.

9. The mixture according to claim 1, wherein the carbon is present in the form of micronised graphite with the carbon content of the mixture in the range 0.45 to 1.5%.

10. The mixture according to claim 1, wherein an amount of the iron content not exceeding 5% of the total mixture has been replaced by one or more elements which do not adversely affect the tensile strength and ductility of the resultant articles obtained by powder metallurgy.

* * * * *